US010571218B2

(12) United States Patent
Cahill

(10) Patent No.: US 10,571,218 B2
(45) Date of Patent: Feb. 25, 2020

(54) RAIL INTERFACE SYSTEM

(71) Applicant: TangoDown, Inc., Tucson, AZ (US)

(72) Inventor: Jeffrey Matthew Cahill, Tucson, AZ (US)

(73) Assignee: TangoDown, Inc., Tucson, AZ (US)

( * ) Notice: Subject to any disclaimer, the term of this patent is extended or adjusted under 35 U.S.C. 154(b) by 0 days.

(21) Appl. No.: 16/252,493

(22) Filed: Jan. 18, 2019

(65) Prior Publication Data

US 2019/0249948 A1 Aug. 15, 2019

Related U.S. Application Data

(60) Provisional application No. 62/619,521, filed on Jan. 19, 2018.

(51) Int. Cl.
*F41C 27/00* (2006.01)
*F41G 11/00* (2006.01)

(52) U.S. Cl.
CPC ..... *F41C 27/00* (2013.01); *F41G 11/001* (2013.01)

(58) Field of Classification Search
CPC ..... F41C 27/00; F41G 11/001; F41G 11/002; F41G 11/003; F41G 11/004
See application file for complete search history.

(56) References Cited

U.S. PATENT DOCUMENTS

| | | | | |
|---|---|---|---|---|
| 7,836,625 | B2 | 11/2010 | Swan et al. | |
| 9,222,749 | B1 * | 12/2015 | Nakayama | F41C 23/16 |
| 9,341,441 | B2 | 5/2016 | Cheng et al. | |
| 9,581,412 | B2 | 2/2017 | Cheng et al. | |
| 9,772,161 | B1 * | 9/2017 | Cheng | F41C 23/16 |
| 9,777,985 | B2 * | 10/2017 | Roberts | F41G 11/001 |
| 10,101,118 | B2 | 10/2018 | Roberts et al. | |
| 10,240,901 | B1 * | 3/2019 | Cheng | F41G 11/003 |
| 2009/0241397 | A1 * | 10/2009 | Fitzpatrick | F41C 23/16 42/90 |
| 2010/0236124 | A1 * | 9/2010 | Troy | F41A 35/02 42/90 |
| 2015/0267993 | A1 | 9/2015 | Cheng et al. | |
| 2016/0209175 | A1 * | 7/2016 | Sharron | F41G 11/003 |
| 2016/0216061 | A1 * | 7/2016 | Cheng | F41G 11/005 |

* cited by examiner

*Primary Examiner* — Gabriel J. Klein
(74) *Attorney, Agent, or Firm* — R. Tracy Crump

(57) ABSTRACT

The rail interface system uses a lever mechanism that pivots to extend through and restrictively engage the edges of the rail openings, thereby securely affixing the weapon accessory against the weapon or weapon component. The lever mechanisms may be adapted for use with M-Lok® or KeyMod style rail openings without the use of specialized nuts and fasteners.

8 Claims, 8 Drawing Sheets

RAIL INTERFACE SYSTEM

This application claims the benefit of U.S. Provisional Application No. 62/619,521 filed Jan. 19, 2018, the disclosure of which is hereby incorporated by reference.

This invention relates to a rail interface system for small firearms, and in particular a rail interface system using a lever mechanism extending through a rail opening to provide the locking force that secures the accessories directly to the rail.

BACKGROUND OF THE INVENTION

Rail interface systems ("RIS"), also commonly referred to as rail accessory systems, is a generic term for a system for attaching weapon accessories to small firearms such as pistols, rifles and light machine guns. Common weapon accessories include tactical lights, laser aiming modules, forward hand grips, weapon sights and optics, and bipods. A variety of rail interface systems have been developed for military and civilian application, including Picatinny (MIL-STD-1913), KeyMod and M-Lok®. These rail interface systems are well known in the firearms industry and most weapon accessories are compatible with one or more rail interface system.

The KeyMod RIS was developed by VLTOR Weapon Systems of Tucson, Ariz., and released through Noveske Rifleworks of Grants Pass, Oreg., before being published in the public domain for adoption by the entire firearms accessory industry. The KeyMod RIS consists of a series of "key hole" shaped rail openings formed in the handguard or other weapon component and a complimentary nut. The KeyMod slot is distinctive with a larger diameter through-hole combined with a narrow slot. The KeyMod nut is stepped and the larger diameter end is chamfered to mate against chamfer edges on the backside of the KeyMod slot.

The M-LOK® RIS was developed by Magpul Industries, Corp. of Austin, Tex. and protected by several patents including U.S. Pat. Nos. 8,925,236; 9,239,209; 9,239,210; 9,429,388; and 9523,554. M-LOK® is a registered trademark of Magpul Industries, Corp. The M-LOK® RIS consists of a series of elongated rail openings ("slots") formed in the handguard, rail or other weapon component, and a specialized T-slot nut capable of only 90-degree rotation. The "quarter-turn" T-slot nuts have a "cammed" surface that allow the "T" section to engage the backside of the handguard or rail when the fastener bolts draw down on the nuts securing the attachment of the accessory. The cammed surface also allows the "T" section to disengage the backside of the handguard or rail when fasteners are loosened.

KeyMod and M-Lok are popular rail interface systems that aim to supersede the Picatinny military standard rail interface system (MIL-STD-1913). Both KeyMod and M-Lok® rail interface systems eliminate the need for weapon components, particularly handguards to be fully outfitted with "Picatinny" style rails. Both KeyMod and M-Lok® RIS enable the user to have a slimmer, lighter, smoother and better fenestrated handguard/fore-end with accessories mounted only where needed, whereas a Picatinny handguard typically will have rail slots along its whole length resulting in a heavier and bulkier handguard with sharp edges and poorer barrel ventilation. However, both KeyMod and M-Lok® RIS require the use of separate specialized fasteners.

SUMMARY OF INVENTION

The improved rail interface system of this invention uses a lever mechanism that pivots to extend through and engage the edges of the rail openings to securely affix the weapon accessory against the weapon or weapon component. The lever mechanisms use "under-hook" type protrusions that are pivoted to engage both the opposed edges of rail openings and the inner surface of the rail section securely affixing the weapon accessory against the weapon or weapon component. The lever mechanisms may be adapted for use with M-Lok® or KeyMod style rail openings without the use of specialized nuts and fasteners. The integrated lever mechanisms provide a quick and secure integrated interface connection. The lever mechanisms of the RIS of this invention may be integrated into the design and functionality of any particular weapon accessory or accessory mount.

In certain exemplary embodiments, the RIS of this invention is incorporated into rail covers used with a weapon component having conventional M-Lok style rail openings. In those embodiments, the rail covers include one or more levers that pivot between open and closed positions to engage the edges of the rail openings. In another exemplary embodiment, the RIS of this invention is incorporated into the accessory mount of a weapon light. In that embodiment, the mount body includes a lever that again pivots between open and closed positions to engage the edges of the rail openings.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DETAILED DESCRIPTION

Figure 1:
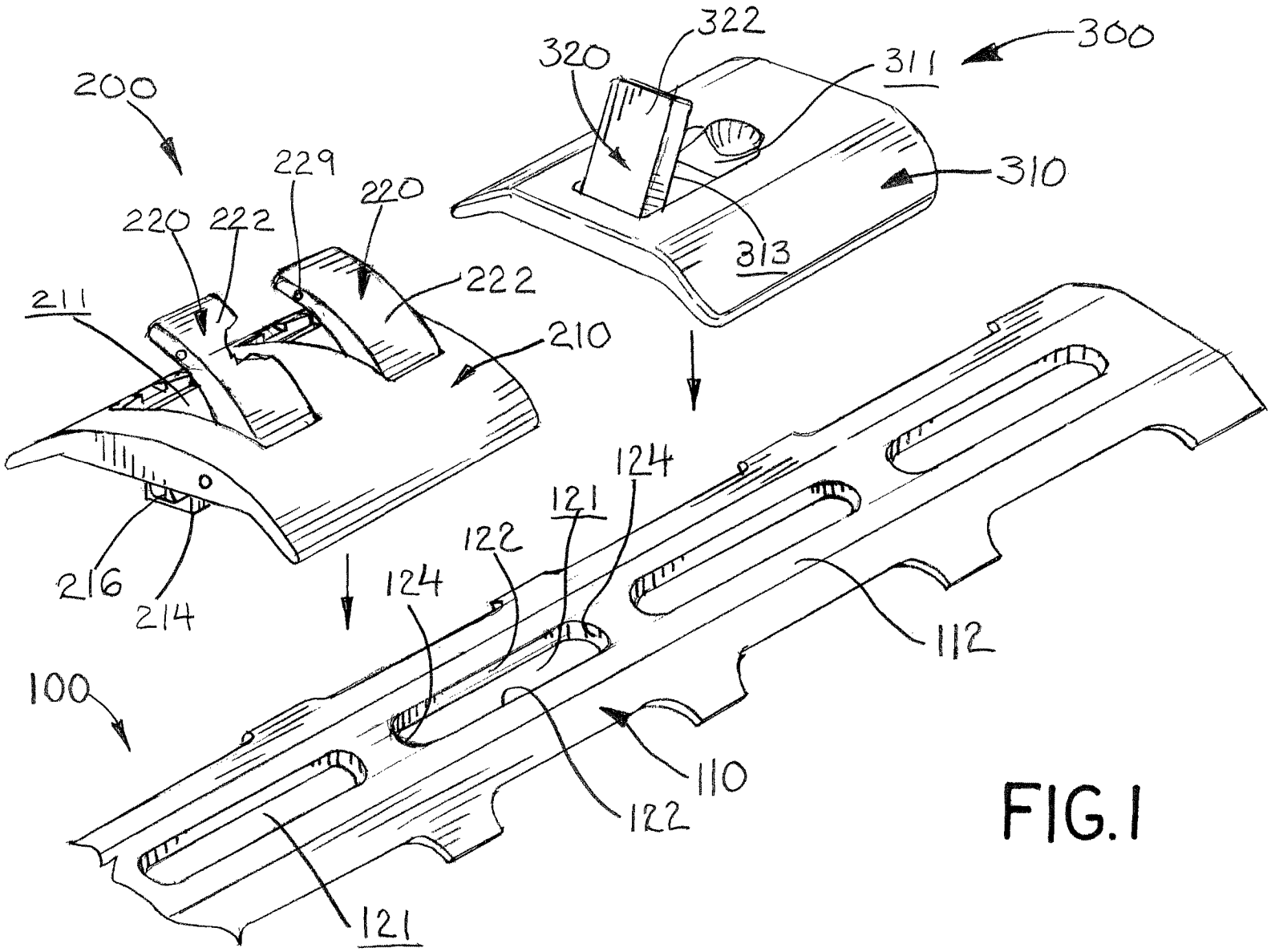
FIG. 1 is an exploded view of an exemplary embodiment of the rail interface systems of this invention shown using an embodiment of a rail section and two embodiments of rail covers.

In the following detailed description of the exemplary embodiments, reference is made to the accompanying drawings that form a part hereof, and in which is shown by way of illustration specific embodiments in which the invention may be practiced. These embodiments are described in sufficient detail to enable those skilled in the art to practice the invention, and it is understood that other embodiments may be utilized and that logical, structural and mechanical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The drawings illustrate exemplary embodiments of the improved rail interface system ("RIS") of this invention. The RIS of this invention consists of complimentary components and component features that interface to securely attach the weapon accessory to the weapon or weapon component. In particular, the complimentary features and components of the RIS of this invention consist of a series of interface or "rail" openings formed in the weapon or weapon component and a lever mechanism incorporated into the weapon accessory that pivots to extend through and restrictively engage the edges of the opening thereby securely affixing the weapon accessory against the weapon or weapon component.

The rail openings used as part of the RIS of this invention may be formed in any weapon structure or component to which an accessory may be attached, but are most commonly formed in the hand guards or receivers. Furthermore, the arrangement and location of the rail opening on the weapon or weapon component may vary depending on application and purpose. The rail openings may all be of similar or identical size. In other alternative embodiments, rail openings can have differing sizes. Furthermore, the rail openings may or may not have consistent or constant lengths (the longer dimension of an opening) or widths (the smaller dimension of an opening). As illustrated throughout this disclosure, the rail openings can be arranged in rows such that the longer dimension of each opening is aligned with the longer dimension of at least one other opening.

In each embodiment of the RIS system of this invention, a lever mechanisms is used securing hold the accessory component to the rail section where"under-hook" protrusions engage the edges of rail openings and the inner surface of the rail section. The lever mechanisms used as part of the RIS of this invention may be integrated into the design and functionality of any particular weapon accessory. The lever mechanisms of this invention may be incorporated directly into the design of a weapon accessory or into the design of a mount for any such accessory. The lever mechanism may be incorporated into weapon accessories, such as Picatinny® rail sections, handle grips, lights, lasers, and sling connections.

Ideally, the RIS of this invention is adapted to utilize M-Lok® or KeyMod® style rail openings (the elongated slots for M-Lok® or the keyhole openings for KeyMod®) without the use of M-Lok® and KeyMod® style fasteners. The lever mechanism eliminates the need for separate M-Lok® and KeyMod® style fasteners with existing weapons and weapon components having M-Lok® and KeyMod® style rail openings, while still providing a quick, convenient and secure integrated interface connection. In other alternative embodiments, the lever mechanisms can be modified and adapted to interface with the rail openings of any configuration or dimension as required.

Referring now to the drawings, FIGS. 1-8 illustrate the RIS of this invention using an exemplary embodiment of a weapon rail panel 100 and two exemplary embodiments of rail covers 200 and 300. Generally, rail covers are commonly used to cover weapon rails and hand guards on M16/M4 style rifles and other rail systems. As shown, rail panel 100 is a simplified depiction of a section of a conventional rail section of a firearm hand guard (not shown) of the kind used on AR-15 style rifles. Rail covers 200 and 300 are intended to mount to a weapon or weapon component, such as rail panel 100, to provide a grip surface and/or thermal barrier.

Rail section 100 is of conventional construction and may be machined, cast, molded or extruded from any suitable metal, plastic or composite material. Rail section 100 has an elongated body 110 having a subtle arcuate cross section with an outer surface 112 and an inner surface 114. Rail section 100 also has a plurality of elongated "M-Lok" style rail openings 121 (four slots are shown). Rail openings 121 are longitudinally aligned in a row formed along the longitudinal axis of rail body 110. Ideally, rail openings 121 are configured and dimensioned to be M-Lok compliant. As shown, each rail opening 121 is defined by a peripheral edge having opposed parallel side edges 122 and rounded end edges 124.

Rail covers 200 and 300 are substantially identical in form and function and differ only in the configuration of their lever mechanisms. The lever mechanism of rail cover 200 uses a pair of levers designed to restrictively engage the side edges of rail openings 121. The lever mechanism of rail cover 300 uses a single lever designed to restrictively engage the rounded end edges of rail openings 121. Both rail covers 200 and 300 are generally cast, formed or molded of a suitable plastic or composite material, which are selected to provide the desired durable, texture and thermal insulating properties. Both rail covers 200 and 300 have a cover body that is configured to lie over and partially cover outer surface 112 of rail panel 100.

Figure 2:
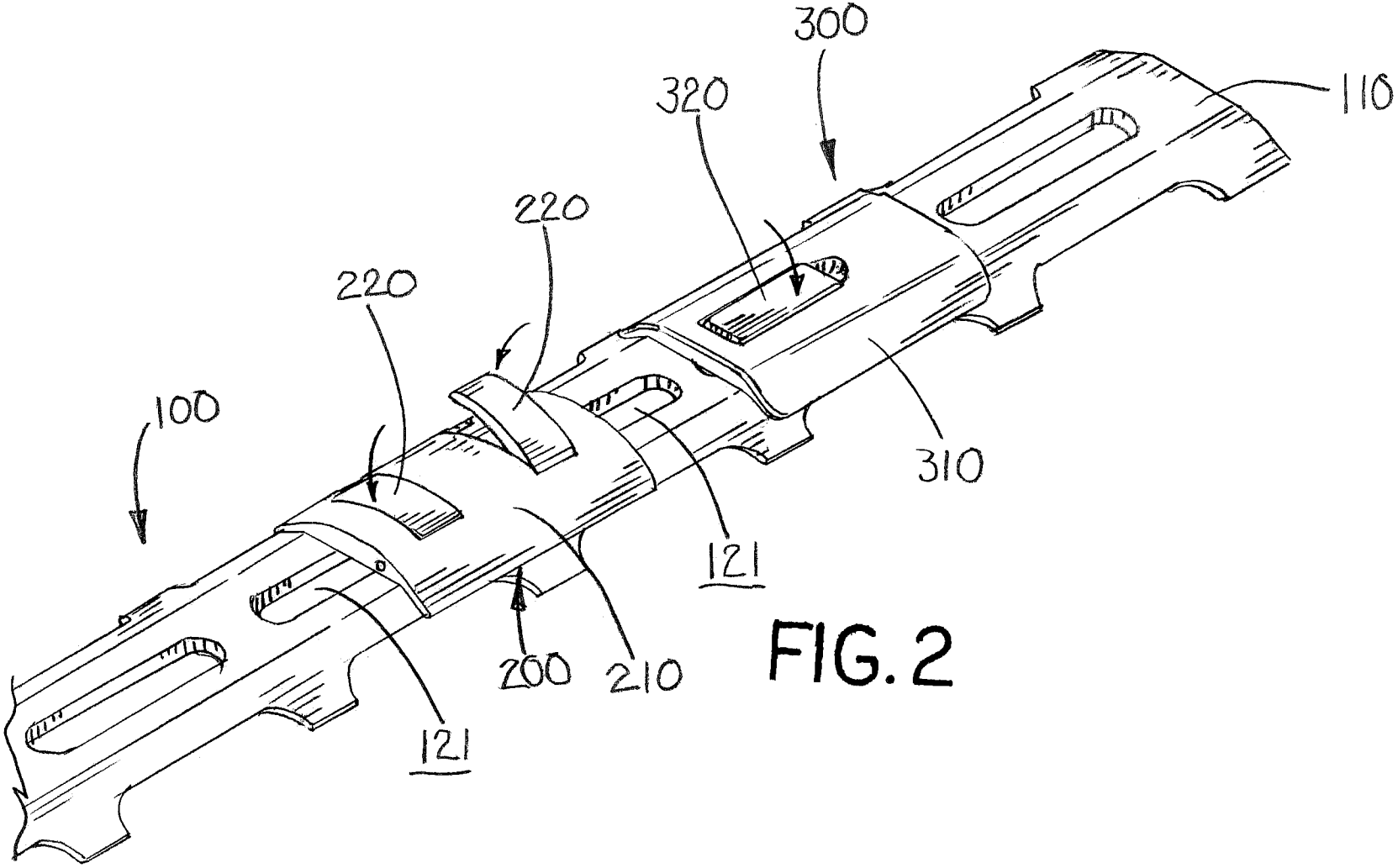
FIG. 2 is a perspective view of the rail interface system of FIG. 1.
Figure 5:
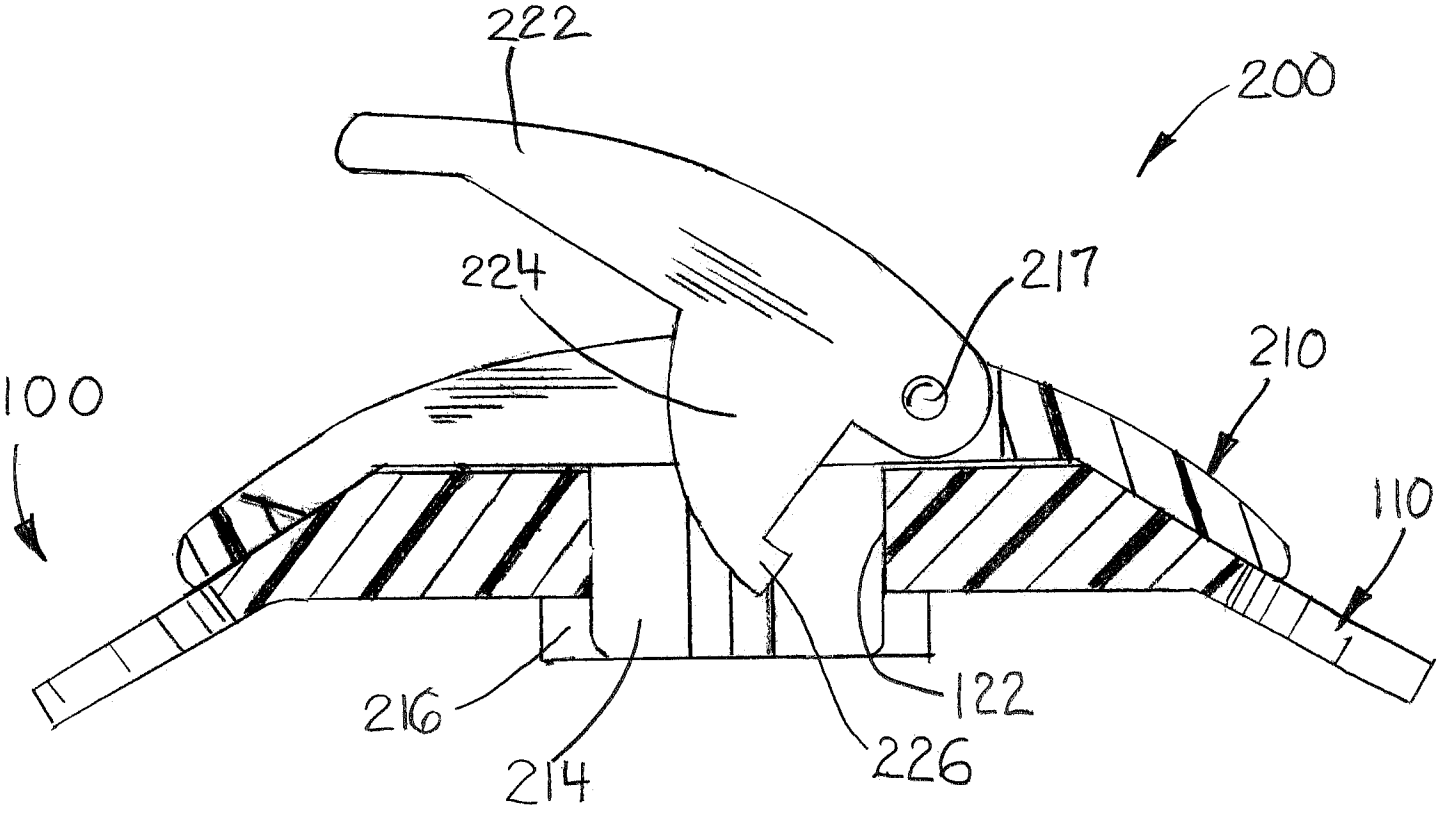
FIG. 5 is a side sectional view of the first rail cover embodiment of FIG. 1 shown with the levers in the open position.
Figure 6:
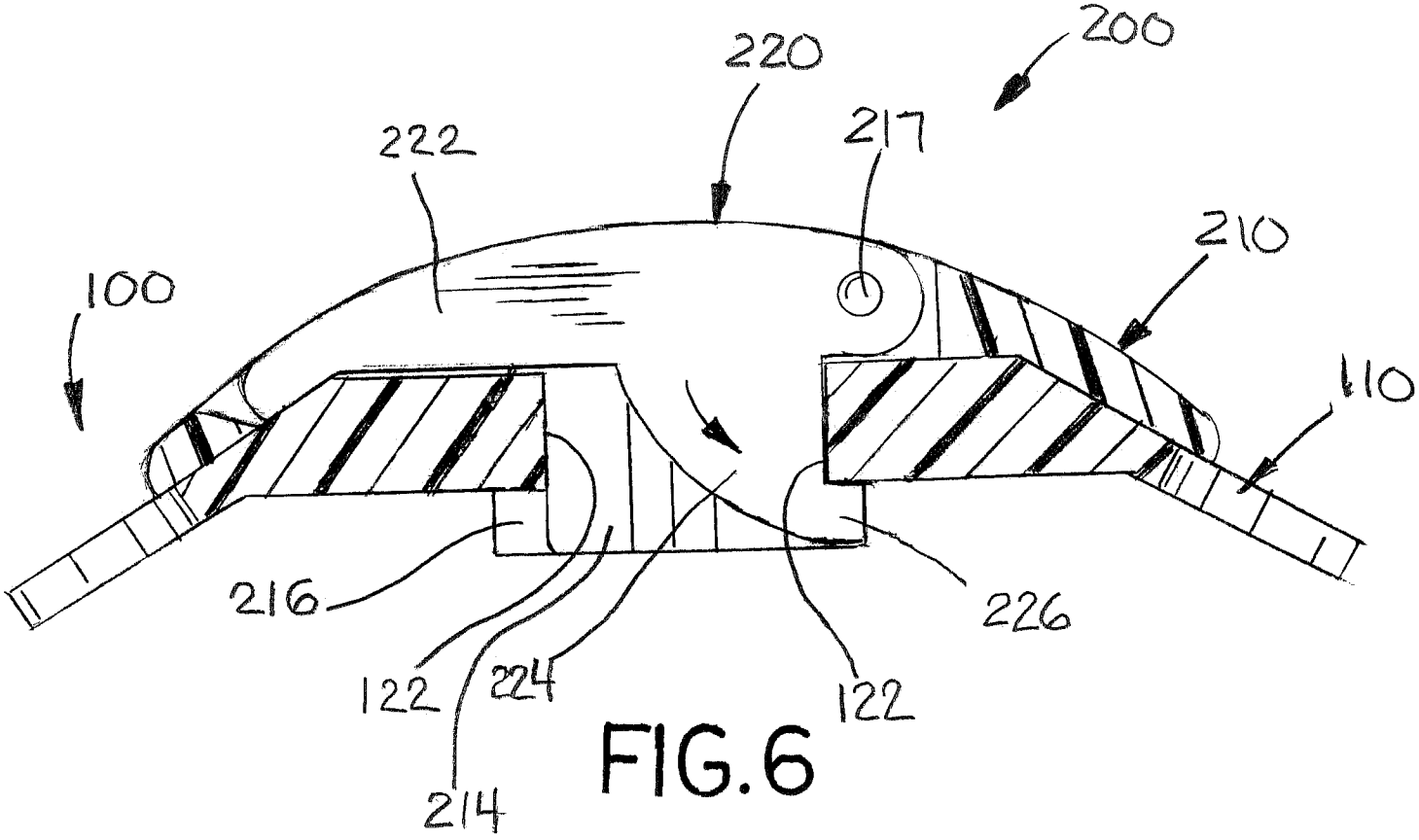
FIG. 6 is a side sectional view of the first rail cover embodiment of FIG. 1 shown with the levers in the closed position.
Figure 7:
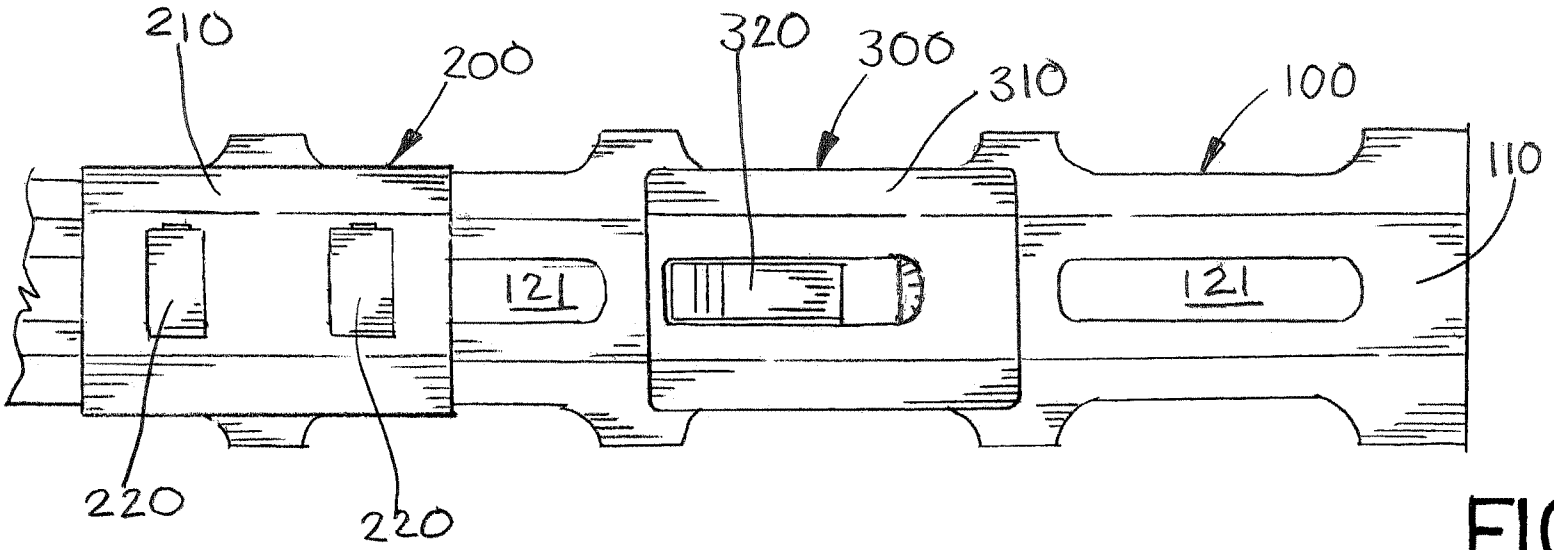
FIG. 7 is a top plan view of the rail interface system of FIG. 1 showing the first and second rail cover embodiments with levers in the closed position.
Figure 8:
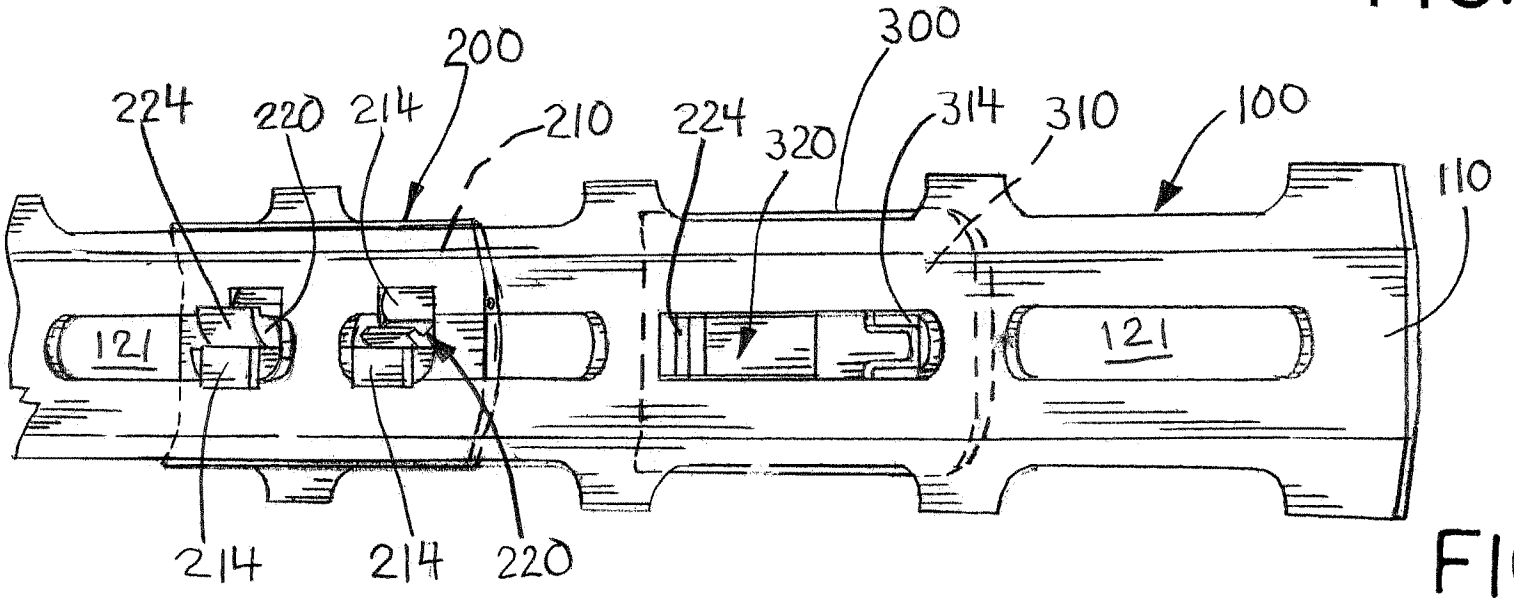
FIG. 8 is a top plan view of the rail interface system of FIG. 1 showing the first and second rail cover embodiments with levers in the open position.

As best shown in FIGS. 3, 5-7, rail cover 200 includes a cover body 210 and a pair of laterally oriented "lock" levers 220. Levers 220 are pivotally connected to the cover body for movement between an unlocked position (FIG. 1) and a locked position (FIG. 2). Cover body 210 has a pair of recessed channels 211 formed in its outer surface, which each open into a through opening 213. Cover body 210 also has a pair of integral L-shaped body protrusions ("the body under-hooks") 214 that extend from the inward, i.e., the rail facing surface of the cover body (FIG. 5). Body protrusion 214 terminates in a foot 216. Levers 220 have a lever handle 222 and an L-shaped lever protrusion (the "lever under-hook") 224. Like body protrusions 214, each lever protrusion 224 terminates in a foot 226. Body protrusions 214 and lever protrusions 224 are similarly configured and dimensioned to receive side edge 122 of rail openings 121 in a secure engagement when levers 220 are in the locked position. Levers 220 seat within channels 211 and through openings 213 and align opposite body protrusions 214. Lever 220 pivots about a pair of opposed pintle 227 that extend laterally from the sides of the lever and seat within detents 217 formed in the sidewalls that define through opening 213. Lever 220 also includes a second pair of opposed pintle 229 that seat in a second pair of detents 119 formed in the sidewall of channel 211.

Rail cover 200 is attached to rail section 100 by manually seating body protrusion 214 within one of the rail openings 121 against one of the side edges 122. With body protrusions 214 abutting side edge 122, levers 220 are manually pivoted from the open position to the locked position. In the locked position, protrusions 214 and 224 and feet 216 and 226 "under-hook" opposed side edges 122 of rail section 100. Pressing lever handles 222 into channel 211 pivots into engagement against the opposite side edge 122 of rail opening 121 and feet 216 and 226 into engagement against the inner surface 114 of panel body 110. In the locked position, lever 220 press both body protrusions 214 and lever protrusions 224 against opposing side edges 122 of rail opening 121, which locks rail cover 200 to rail section 100. In the locked position, handles 222 seat within channels 211 generally flush with outer surface 112 of panel body 110 and are held in place by the engagement of pintle 228 seated within detents 219. In the open position, lever handles 222 are pivoted outward from channel 211 and lever protrusions 224 are pivoted out of engagement with side edge 122 and inner surface 114. With lever 220 in the open position, rail cover 200 can be detached from rail section 100.

Figure 4:
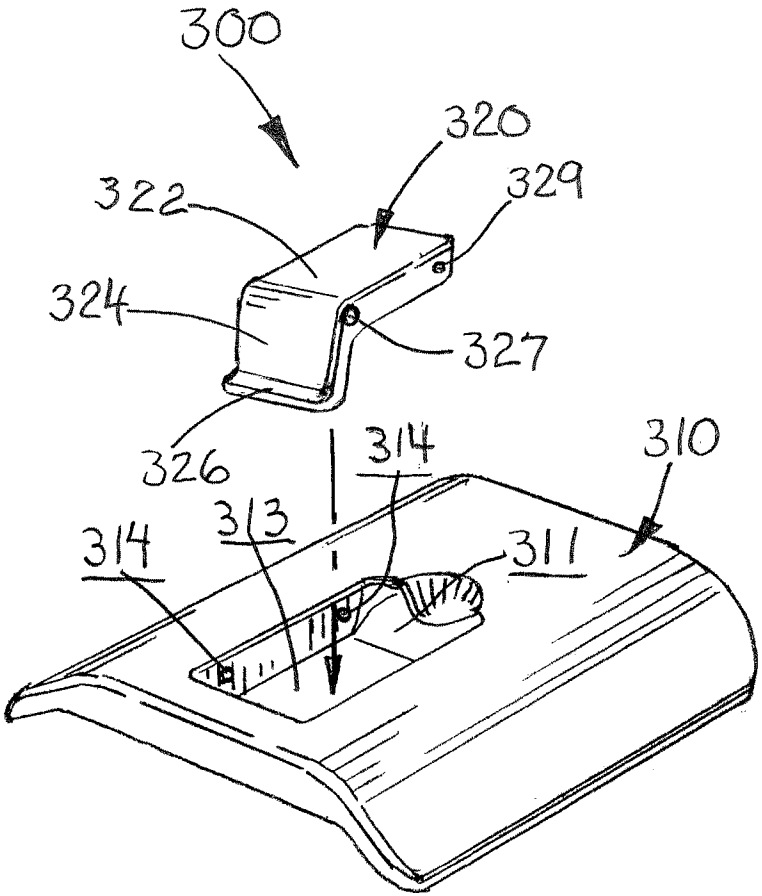
FIG. 4 is an exploded view of the second rail cover embodiment of FIG. 1.
Figure 3:
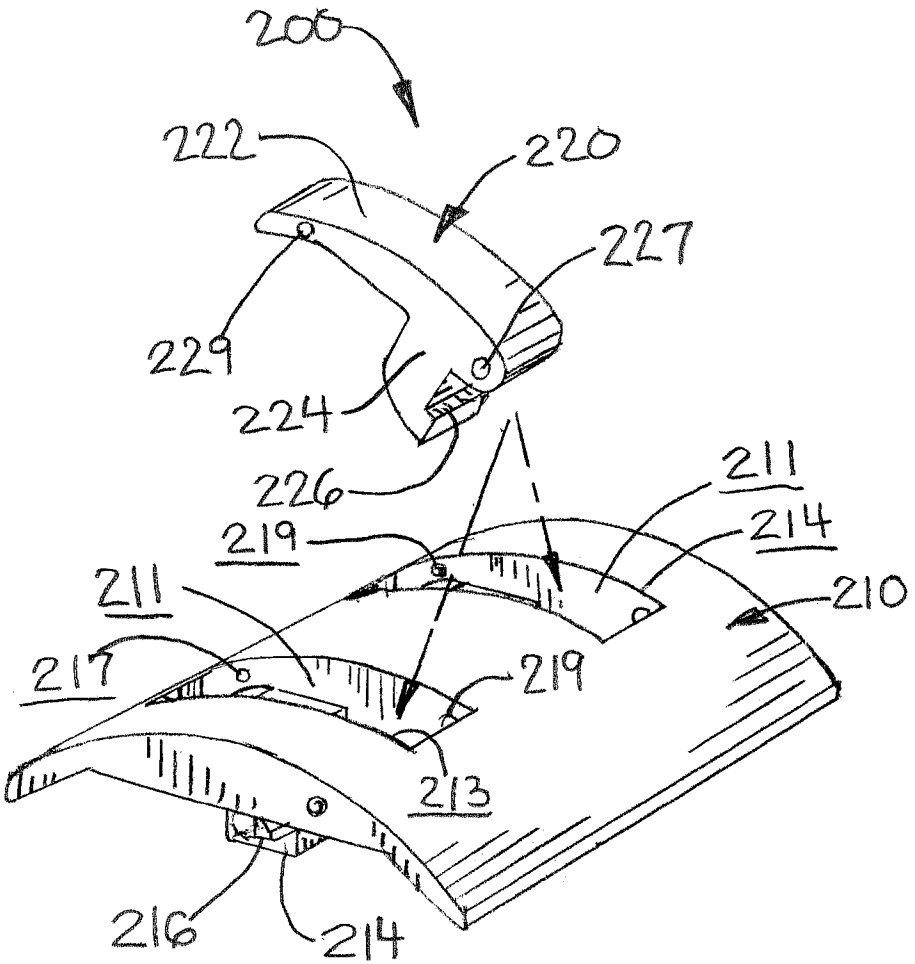
FIG. 3 is an exploded view of the first rail cover embodiment of FIG. 1.

As best shown in FIG. 4, rail cover 300 includes a cover body 310 and a longitudinally oriented lever 320. Lever 320 is pivotally connected to cover body 310 for movement between an unlocked position (FIG. 1) and a locked position (FIG. 2). Cover body 310 has a recessed channel 311 that opens into a through opening 313. Cover body 310 also has an integral L-shaped body protrusion (the "body under-hook") 314 that extends from the inward, i.e., the rail facing surface of the cover body. Body protrusion 314 terminates in a foot 316. Levers 320 have a lever handle 322 and an L-shaped lever protrusion (the "lever under-hook") 324. Like body feet 314, lever protrusion 324 terminates in a foot 226. Both body protrusion 314 and lever protrusion 324 are configured and dimensioned to receive the rounded end edges 124 of rail openings 121 in a secure engagement when lever 320 is in the locked position. As with rail cover 200, lever 320 seats within channels 311 and through openings 213 and aligns opposite body protrusion 314. Lever 320 pivots about a pair of opposed pintle 327 that extend laterally from the sides of lever 320 and seat within detents 217 formed in the sidewalls that define through opening 213. Lever 320 also includes a second pair of opposed pintle 329 that seat in a second pair of detents 319 formed in the sidewall of channel 311.

Rail cover 300 is attached to rail section 100 in the same manner as rail cover 200. With body protrusion 314 abutting one of the rounded end edges 124 of the rail opening 121, lever 320 is manually pivoted from the unlocked position to the locked position. As with rail cover 200, protrusions 314 and 324 and feet 316 and 326 "under-hook" opposed side edges 122 of rail section 100 in the locked position. Pressing lever handles 322 into channel 311 pivots lever protrusion 324 into engagement against the opposite rounded end edge 124 and foot 216 into engagement against the inner surface 114 of panel body 110. Again, lever 320 is held in the locked position by the press engagement of pintle 328 seating with detents 319. In the open position, lever handles 322 are pivoted outward from channel 311 and lever protrusion 324 is pivoted out of engagement with end edge 124 and inner surface 114 allowing cover 200 to be detached from rail section 100.

Figure 9:
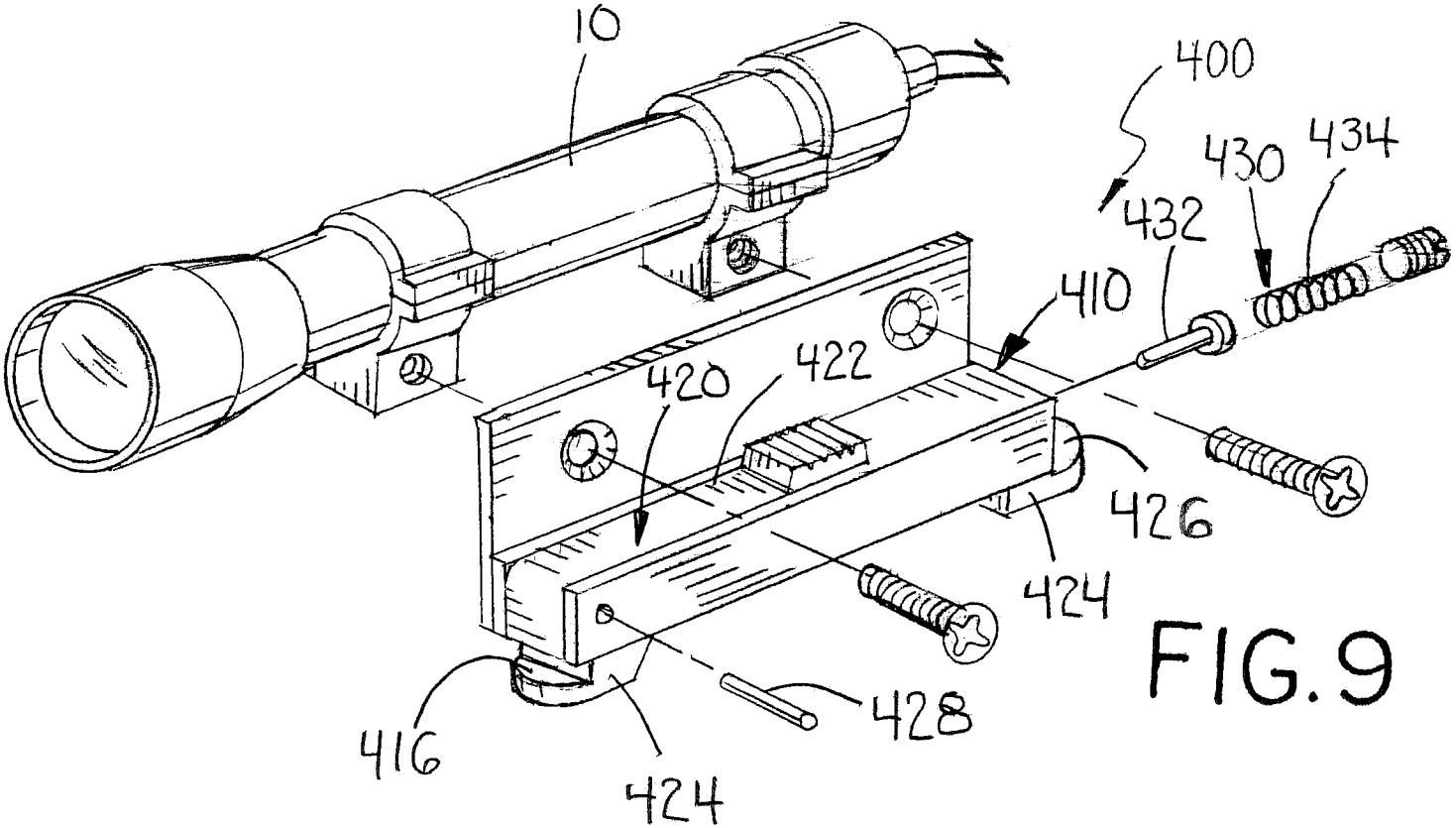
FIG. 9 is an exploded view of another exemplary embodiment of the rail interface system of this invention show adapted to an embodiment of a weapon light mount.
Figure 10:
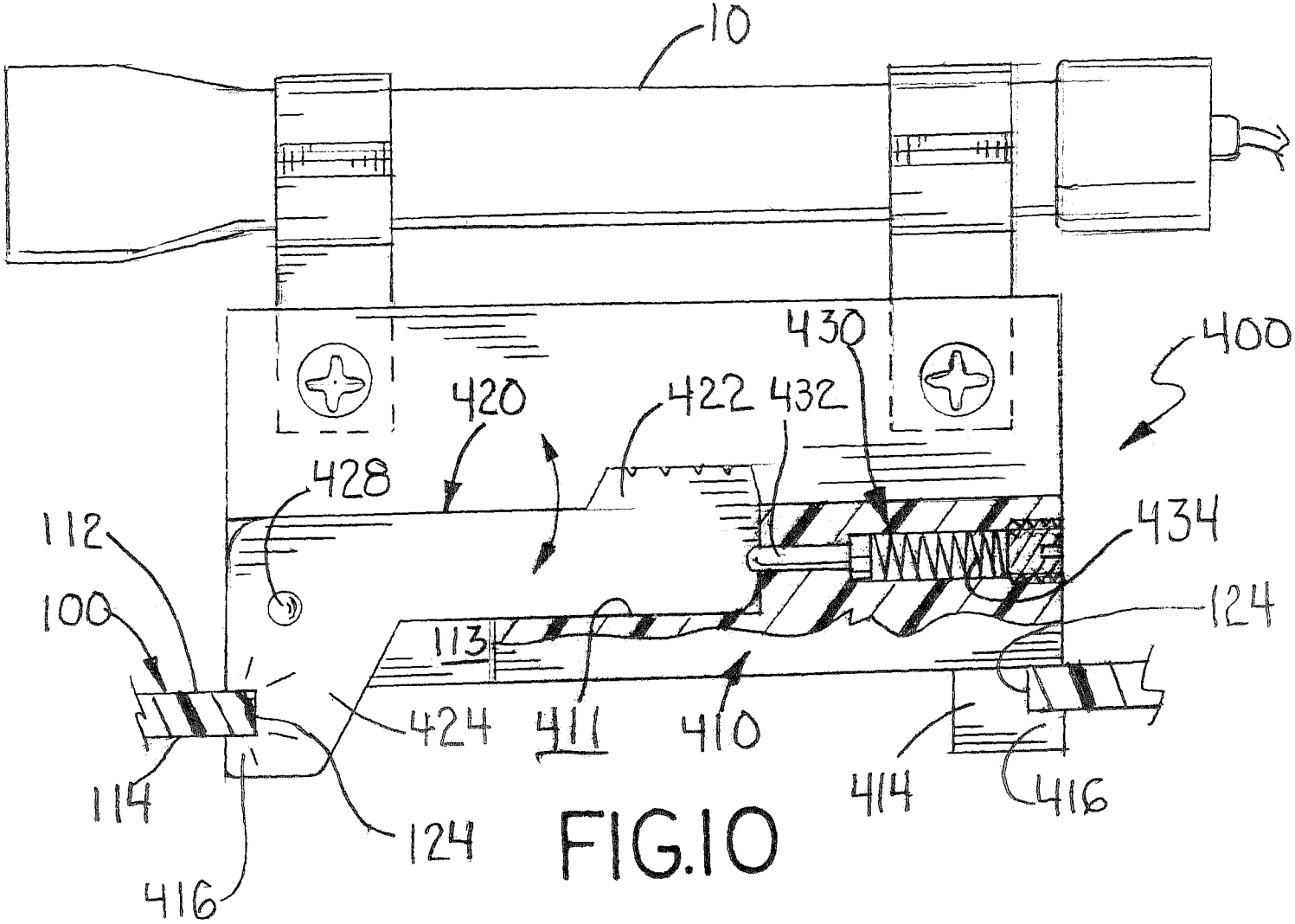
FIG. 10 is a partial side sectional view of the rail interface system of FIG. 9.

FIGS. 9 and 10 illustrate the RIS of this invention using an exemplary embodiment of a weapon light mount 400. For simplicity and brevity of explanation, mount 400 is shown in FIG. 10 attached to the weapon rail panel 100 of FIGS. 1,2, 5-8 and described above. Light mount 400 is adapted to support a conventional weapon light 10, a laser or similar device. Mount 400 includes a mount body 410 and a longitudinally oriented lever 420 pivotally connected to mount body 410 for movement between an open position and a locked position. Mount body 410 includes an integral L-shaped body protrusion ("body under-hook") 414 that extends from its bottom surface. Body protrusion 414 terminates in a foot 416. Lever 420 has a lever handle 422 and an integral L-shaped lever protrusion (the "lever under-hook") 424. Like body protrusion 414, lever protrusion 424 terminates in foot 426. Both protrusions 414 and 424 are configured and dimensioned to receive the rounded end edges 124 of rail openings 121 in a secure engagement when lever 420 is in the locked position. Lever 420 is pivotally connected to mount body 410 by roll pin 428. In the closed position, lever 420 rests in a recessed channel 411 formed in mount body 410 with lever protrusion 424 extending through an opening 413 at one end of the mount body. Mount body 410 also includes a lock pin 430 that engages the end lever handle 422 to lock lever 420 in the closed position. Lock pin 430 includes a pin 432 and a coil spring 434 disposed in an internal longitudinal bore 431 in mount body 410.

Light mount 400 attaches to rail section 100 in the same manner using the engaging under-hooks at the end edges 114 as rail cover 300. Manually pivoting lever 420 from the open position to the locked position pivots lever protrusion 424 into engagement against the opposite rounded end edges 124 of rail opening 121 and foot 426 into engagement against the inner surface 114 of panel body 110. Handle 422 is held in the locked position by lock pin 430 biased by spring 434. In the open position, lever handles 422 are pivoted outward from channel 411 and lever feet 424 are pivoted out of engagement with end edge 124 of rail opening 121.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A rail interface system for connecting an accessory component to a weapon component, the interface system comprising:

the weapon component having a first rail surface, a second rail surface, and at least one elongated rail opening extending through the weapon component between the first surface and the second surface, the rail opening defined by a peripheral edge formed between the first surface and the second surface, the peripheral edge having opposed longitudinal end edges;

the accessory component includes an accessory body configured to cover and overlie the rail opening, the accessory body having opposed longitudinal ends, an opening extending there through and having a perimeter inset between the opposed longitudinal ends, and a contact surface, the accessory component also includes a lever pivotally connected to the accessory body within the opening for movement between a locked position and an unlocked position to secure the accessory component to the weapon component with the contact surface abutting the first rail surface, the lever includes a lever handle and a lever protrusion extending from the lever handle, the lever handle is seated within the body opening when the lever is in the locked position and extended from the body opening when the lever is in the unlocked position, the lever protrusion pivotally extends through the rail opening restrictively engaging one of the opposed end edges and the second rail surface when the lever is in the locked position and disengaging from the one of the opposed end edges and the second rail surface when the lever is in the unlocked position.

2. The interface system of claim 1 wherein the accessory body also includes a body protrusion extending from the contact surface, the body protrusion extending through the rail opening and restrictively engaged against the other of the opposed end edges and the second rail surface when the lever is in the locked position.

3. The interface system of claim 1 wherein the lever protrusion includes a foot extending opposite the lever handle, the protrusion foot abuts against the second rail surface when the lever is in the locked position and is pivoted away from the second rail surface when the lever is in the unlocked position.

4. The interface system of claim 2 wherein the body protrusion includes a protrusion foot, the protrusion foot abuts against the second rail surface when the lever is in the locked position.

5. A rail interface system for connecting an accessory component to a weapon component, the interface system comprising:

the weapon component having a first rail surface, a second rail surface, and at least one elongated rail opening extending through the weapon component between the first surface and the second surface, the rail opening defined by a peripheral edge formed between the first surface and the second surface, the peripheral edge having opposed lateral side edges; and the accessory component includes an accessory body configured to cover and overlie the rail opening, the accessory body having opposed lateral sides, an opening extending there through and having a perimeter and inset from the opposed lateral sides, and a contact surface, the accessory component also includes a lever pivotally connected to the accessory body within the opening for movement between a locked position and an unlocked position to secure the accessory component to the weapon component with the contact surface abutting the first rail surface, the lever includes a lever handle and a lever protrusion extending from the lever handle, the lever handle is seated within the body opening when the lever is in the locked position and extended from the body opening when the lever is in the unlocked position, the lever protrusion pivotally extends through the rail opening and restrictively engaging one of the opposed side edges and the second rail surface when the lever is in the locked position and disengaging from the one of the opposed side edges and the second rail surface when the lever is in the unlocked position.

6. The interface system of claim 5 wherein the accessory body also includes a body protrusion extending from the contact surface, the body protrusion extending through the rail opening and restrictively engaged against the other of the opposed side edges and the second rail surface when the lever is in the locked position.

7. The interface system of claim 5 wherein the lever protrusion includes a foot extending opposite the lever handle, the protrusion foot abuts against the second rail surface when the lever is in the locked position and is pivoted away from the second rail surface when the lever is in the unlocked position.

8. The interface system of claim 6 wherein the body protrusion includes a protrusion foot, the protrusion foot abuts against the second rail surface when the lever is in the locked position.

* * * * *